US008032966B1

(12) United States Patent
Keller

(10) Patent No.: US 8,032,966 B1
(45) Date of Patent: Oct. 11, 2011

(54) HAND-GRIPABLE PRESENTATION MARKER CARRIER

(75) Inventor: Scott Keller, Shriley, MA (US)

(73) Assignee: Scott T. Keller, Hubbardstow, MA (US)

( * ) Notice: Subject to any disclaimer, the term of this patent is extended or adjusted under 35 U.S.C. 154(b) by 948 days.

(21) Appl. No.: 11/187,102

(22) Filed: Jul. 23, 2005

(51) Int. Cl.
*B47L 21/00* (2006.01)

(52) U.S. Cl. ..... 15/105; 15/104.92; 15/145; 15/209.1; 15/210.1; 15/223; 15/224; 15/231; 15/232

(58) Field of Classification Search ..... 15/105, 15/210.1, 231, 232, 145, 209.1, 104.92, 424, 15/223, 224
See application file for complete search history.

(56) References Cited

U.S. PATENT DOCUMENTS

| | | | | | |
|---|---|---|---|---|---|
| 3,110,917 | A | * | 11/1963 | McPeek, Jr. | 15/118 |
| 3,866,992 | A | * | 2/1975 | Katz | 211/69.5 |
| 4,543,680 | A | * | 10/1985 | Vlahos | 15/145 |
| 4,875,591 | A | * | 10/1989 | Mikesell | 211/69.1 |
| 5,072,483 | A | | 12/1991 | Durand | |
| 5,232,103 | A | * | 8/1993 | Koenig et al. | 211/69.5 |
| 5,365,631 | A | * | 11/1994 | Emerick | 15/105 |
| 5,432,973 | A | * | 7/1995 | Wagner et al. | 15/210.1 |
| D362,683 | S | | 9/1995 | Wagner et al. | |
| D368,277 | S | * | 3/1996 | Schuster et al. | D19/85 |
| D398,644 | S | | 9/1998 | Krapf | |
| 5,947,624 | A | * | 9/1999 | Davignon | 401/202 |
| 5,957,603 | A | | 9/1999 | Bell | |
| 6,048,121 | A | | 4/2000 | Carver | |
| 6,202,862 | B1 | * | 3/2001 | Acquaviva et al. | 211/69.5 |
| 6,793,430 | B1 | * | 9/2004 | Liu | 401/131 |
| 6,948,874 | B2 | * | 9/2005 | Roberson | 401/139 |
| 7,314,142 | B2 | * | 1/2008 | Lyman, Jr. | 211/69.5 |

* cited by examiner

*Primary Examiner* — Robert Scruggs

(57) ABSTRACT

A hand-gripable presentation marker carrier is disclosed for holding and quickly accessing a plurality of different color presentation markers. The carrier includes a hand-gripable support element including a plurality of marker-tip receiving structures disposed along a surface of the hand-gripable support element, the surface of the hand-gripable support element supporting each of the marker-tip receiving structures. The carrier can also include an eraser housing for receiving an eraser assembly. The plurality of presentation markers are held perpendicularly with respect to the surface of the support element, and each marker-tip receiving structure is shaped so as to grip a marker at its tip-end and hold it to the common hand-gripable support element regardless of the orientation of the common hand-gripable support element. The eraser assembly is sized such that it fits snugly within the eraser housing, and can be inserted and removed from the eraser housing with convenient and comfortable force.

7 Claims, 2 Drawing Sheets

HAND-GRIPABLE PRESENTATION MARKER CARRIER

FIELD OF THE INVENTION

This invention relates to dry erase markers, and particularly to holders for dry erase markers.

BACKGROUND OF THE INVENTION

It is common for presenters, educators, and other speakers to have a spontaneous need to make a presentation with "dry erase" markers and a white board in an office, briefing room, or classroom, but find no working markers. Either the markers are completely absent, or the markers that are available are missing caps, and are consequently dried out and unusable.

At other times, only one color marker is available, but more than one color is needed to make an effective presentation.

Even if all the needed colors are available, it's challenging to manage all the caps for the markers during a demanding presentation. If the caps are not properly managed, the markers begin to dry out during the presentation, making them less effective, resulting in lines that are harder to read as the presentation progresses. Further, the solvent of the "dry erase" markers is highly volatile, and rapidly begins to fill the air with unpleasant and possibly toxic fumes unless the caps of the markers are promptly replaced after the use of each marker.

Also, when there are many colored markers present, they sometimes are stacked precariously on a narrow ledge that is provided with some white boards, resulting in an avalanche of pens onto the floor, thereby delaying or disrupting the presentation.

Moreover, even if a presenter has started a presentation due to the presence of a plurality of markers of various colors, and is managing to cap and un-cap as needed, there is no guarantee that an eraser will be found. In fact, many times it is not possible to find an eraser after the presentation has begun, even though the existence of a usable and conveniently-placed eraser seemed reasonable to assume. Consequently, the hapless presenter is reduced to erasing portions of the presentation using a bare hand.

Marker carriers are known that hold a plurality of markers of various colors. However, it is difficult to remove and replace markers from such carriers during a presentation. Further, these carriers do not protect the tips of the markers, so the user is responsible for removing and replacing the caps for the markers during the presentation, or else tolerate the progressive drying of the markers during the presentation, while the room becomes heavy with the volatilized solvent evaporating from the uncapped markers.

SUMMARY OF THE INVENTION

The hand-gripable presentation marker carrier of the invention holds a plurality of various color presentation markers, such as "dry erase" markers, uncapped, organized, and ready for use, while the marker tips remain protected. In an alternate embodiment, the presentation marker carrier of the invention also conveniently houses an eraser.

According to the invention, markers are maintained uncapped, yet protected, by providing a plurality of marker tip receiving structures that are all supported by a common hand-gripable support element. Unlike known marker holders or carriers that hold markers along the body of the marker, or by the end opposite to the tip of the marker, the marker carrier of the invention secures a plurality of markers solely by the tip-end of the markers, each marker-tip receiving structure acting substantially like a marker cap, in that it protects the marker tip from drying out, becoming contaminated, and other damage.

The marker carrier of the invention maintains a plurality of markers close at hand and stored in an advantageous "ready" position to keep the markers available, yet protected from drying out. Removing a marker from the carrier of the invention is all that needs to be done to use the marker—no uncapping is needed.

Likewise, an alternate embodiment is provided wherein the common hand-gripable support element includes a housing for receiving and carrying an eraser, thereby also keeping an eraser in an advantageous "ready" position.

In a preferred embodiment, being stored in the "ready" position includes maintaining the markers in perpendicular relationship with the common hand-gripable support element. Of course, the markers could also be advantageously maintained in a non-perpendicular relationship with respect to the common hand-gripable support element, such as tilted by ten degrees from perpendicular, for example.

In some embodiments, the carrier of the invention stores four markers, although other numbers of markers are possible, such as three, five, or six markers, for example. More markers typically means greater variety in color.

The markers are placed along the common hand-gripable support element with a separation between marker tip receiving structures such that the fingers of a hand can fit easily around and/or through the receiving structures. The marker tip receiving structures can project above the surface of the common hand-gripable support element, or they can be extend below the surface of the common hand-gripable support element, or they can both project above and extend below the surface of the common hand-gripable support element. Also, when markers are held by the carrier of the invention, the carrier can maintain the markers on the narrow ledge of a white board more readily than stacking them up in an unstable pile that is more likely to collapse and fall to the floor.

The invention is an outstanding briefing/debriefing tool, providing a user with an organized choice of working color markers. When an eraser is embedded within the hand-gripable support element, an eraser is also readily available. Thus, the invention facilitates efficient professional quality presentations.

In addition, the invention also preserves and protects the effectiveness of the markers, prolonging their useful and effective life. The carrier of the invention keeps a set of dry erase markers accessible, ready for a user to put them to work.

The carrier of the invention allows a user to more easily use multiple colors in a whiteboard presentation. Keeping a plurality of different color markers "at the ready" enables a user to quickly transition from one color to another, without having to keep track of marker caps. In embodiments with an integral eraser, it's also easier to clean up and start-over. The various edges and surfaces of the eraser enable a user to easily erase large areas, or single letters, with the same eraser.

When it's critical that a presentation or briefing be clear, organized and rapid, with no room for misunderstanding, the carrier of the invention can be of value by consistently and reliably organizing and protecting four colors of dry erase markers.

The invention maintains a plurality of markers perpendicular to a supporting element, and ensures that the marker tips are protected from drying and other damage. Resting the carrier in a horizontal position enables the markers to be maintained in a vertical position, tips pointing downward, keeping the tips suffused with whatever ink is present in the marker, thereby maintaining the markers ready to use.

The carrier of the invention is preferably made by injection molding with plastic resin, and is consequently rugged and durable.

The carrier of the invention, by keeping track of markers and thereby preventing their loss, effectively reduces office supply costs of replacement markers, and reduces the time wasted in looking for missing functioning markers.

A general aspect of the invention is a hand-gripable presentation marker carrier for holding a plurality of presentation markers. The carrier includes a hand-gripable support element including a plurality of marker-tip receiving structures disposed along a surface of the hand-gripable support element, the surface of the hand-gripable support element supporting each of the marker-tip receiving structures.

In a preferred embodiment, the surface of the hand-gripable support element is the top surface of the support element.

In another preferred embodiment, the plurality of presentation markers are held perpendicularly with respect to the surface of the support element.

In other preferred embodiments, the plurality of marker-tip receiving structures project above the surface of the hand-gripable support element. In alternate preferred embodiments, the plurality of marker tip-receiving structures extend below the surface of the hand-gripable support element. In still other preferred embodiments, the plurality of marker tip-receiving structures both project above and extend below the surface of the hand-gripable support element.

In some preferred embodiments, each marker-tip receiving structure is shaped so as to grip a marker and hold it to the common hand-gripable support element regardless of the orientation of the common hand-gripable support element. In some preferred embodiments, each marker-tip receiving structure serves as a cap to protect the tip from drying.

In yet more preferred embodiments, the hand-gripable support element also has an eraser housing. In further preferred embodiments, the carrier further includes an eraser assembly cooperative with the eraser housing of the hand-gripable support element. In yet further preferred embodiments, the eraser assembly includes an eraser grip and an eraser surface, the eraser surface being inserted into the eraser housing, while the eraser grip remains outside the eraser housing.

In more preferred embodiments, the eraser assembly is sized such that it fits snugly within the eraser housing, and can be inserted and removed from the eraser housing with convenient and comfortable force. In some preferred embodiments, the eraser assembly and the eraser housing are in frictional relationship such that once the eraser assembly is inserted into the eraser housing, the eraser assembly remains within the eraser housing until intentionally removed. In other preferred embodiments, the eraser surface is a rectangular brick-shaped block of standard "dry erase" eraser material.

In preferred embodiments, the plurality of marker-tip receiving structures includes four marker-tip receiving structures. In other preferred embodiments, the spacing between the marker-tip receiving structures is chosen to comfortably allow a typical-sized finger to pass between any pair of receiving structures.

Another general aspect of the invention is a hand-gripable presentation marker carrier for holding a plurality of presentation markers. This carrier includes a hand-gripable support element including a plurality of marker-tip receiving structures disposed along a surface of the hand-gripable support element, the surface of the hand-gripable support element supporting each of the marker-tip receiving structures, and an eraser housing; and an eraser assembly cooperative with the eraser housing of the hand-gripable support element.

In preferred embodiments, the plurality of presentation markers are held perpendicularly with respect to the surface of the support element.

In further preferred embodiments, each marker-tip receiving structure is shaped so as to grip a marker at its tip-end and hold it to the common hand-gripable support element regardless of the orientation of the common hand-gripable support element.

In some preferred embodiments, the eraser assembly is sized such that it fits snugly within the eraser housing, and can be inserted and removed from the eraser housing with convenient and comfortable force.

BRIEF DESCRIPTION OF THE DRAWING

The invention will be more fully understood by reference to the detailed description, in conjunction with the following figures, wherein.

DETAILED DESCRIPTION

Figure 1:
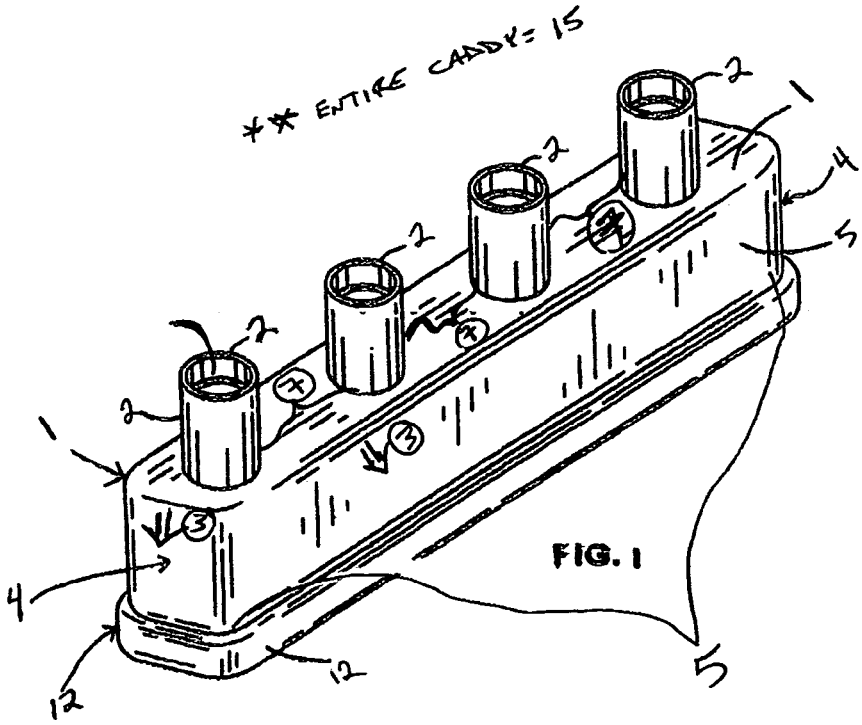
FIG. 1 is a perspective view of an embodiment of the invention having a common hand-gripable support element cooperative with an eraser assembly, wherein the common hand-gripable support element includes an eraser housing having a plurality of marker-tip receiving structures attached along a top surface of the support element, and wherein the eraser assembly includes an eraser grip and an eraser surface, the eraser surface being inserted into the eraser housing, while the eraser grip remains outside the eraser housing.

The Presentation Mate is a "Dynamic" (utilize while presenting information, not just stowage) hand-grip able (vertical and perpendicular to the horizontal surface) dry erase marker carrier, which allows for simultaneously holding (vertically/perpendicular) a plurality of dry-erase multi-colored markers and a (replaceable) dry-eraser pad. The carrier is comprised of the following: a monolithically formed hand-gripable support element [1] having an (horizontal) upper-surface for receiving a plurality of marker-tip receiving structures [2] projecting above (perpendicular to the horizontal structure) and disposed along the upper horizontal surface of the hand-grip able support element [1]. The hand-gripable support element also includes vertically extending side walls that project downward [3] from side surfaces of the upper surface, forming a cavity therein for receiving an (insertable) eraser-pad and lower hand-gripping structure. The side walls being formed from two short parallel side-walls [4] and two long parallel side-walls [5], creating a rectangular shaped caddy (but not limited to that shape). The plurality of marker-tip receiving structures [2] adapted for holding a plurality (multi-colored/multi-sized) of dry erase markers simultaneously [6] (and air-tight), the upper surface of the hand-gripable support element [1] supporting each of the marker-tip receiving structures [2], allows sufficient spacing between the marker-tip receiving structures [7] being chosen to comfortably allow a typical-sized finger to pass between any pair of receiving structures while the dry erase marker carrier is gripped by a user. Each marker-tip receiving structure serving as a cap to protect the tip from drying, since gravity keeps the ink at the tip of the marker pen (dry-erase or paper easel pens), thus providing more efficient use of the pen. The horizontal nature of static caddies causes pens to dry up. The vertical nature of the pen stowage of the Presentation Mate provides for more ink utilization and efficient use without interruption, for a more professional presentation. The Presentation Mate becomes a natural extension to the briefer, which allows the audience to pay closer attention to the information being passed, instead of a fumbling mess of loose pens and separate erasers.

The lower-structure [8], like the upper-structure, has two short parallel side walls [9] and two long parallel side-walls [10], all extending upwards [11] from the lower structure. Additionally, the lip around the rim of the lower structure [12] allows the lower structure to insert into the upper structure [13], which then fits snuggly without the lower structure falling out of the upper-structure. The lower structure also houses (horizontally) a replaceable eraser pad [14] which, while not being used, is housed inside the upper structure when the lower structure in inserted (while gripping) [15]. This inside stowage prevents ink from getting on the hands of the presenter, while hiding the eraser pad when not in use. When the lower structure is inserted into the upper structure, the structure functions as one single functioning caddy, which affords "dynamic" use for the presenter. The marker tip receiving structures have different sized concentric rings inside [16] to allow different sized (but not all) pens to be inserted into the receiving structure holders. This "Dynamic" product is the only one which allows the presenting of information real-time, while utilizing pens, an insertable eraser, and static stowage after the brief is completed.

Operation

The hand-gripable presentation marker carrier of the invention serves as both a holder and a protector of a plurality of dry erase markers, so as to also provide the user with easy simultaneous and organized access to markers of various colors. Because each marker is held in place by engaging its tip in a receiving structure 14, it is not necessary for a user to recap each marker after use.

In a preferred embodiment, an eraser and the markers are all held in place by the same structure, i.e., the common hand-gripable support element 10 which includes a plurality of marker tip receiving structures 14 and the eraser housing 11. Thus, this embodiment ensures that the user will always know where to find all the markers and the eraser.

Figure 2:
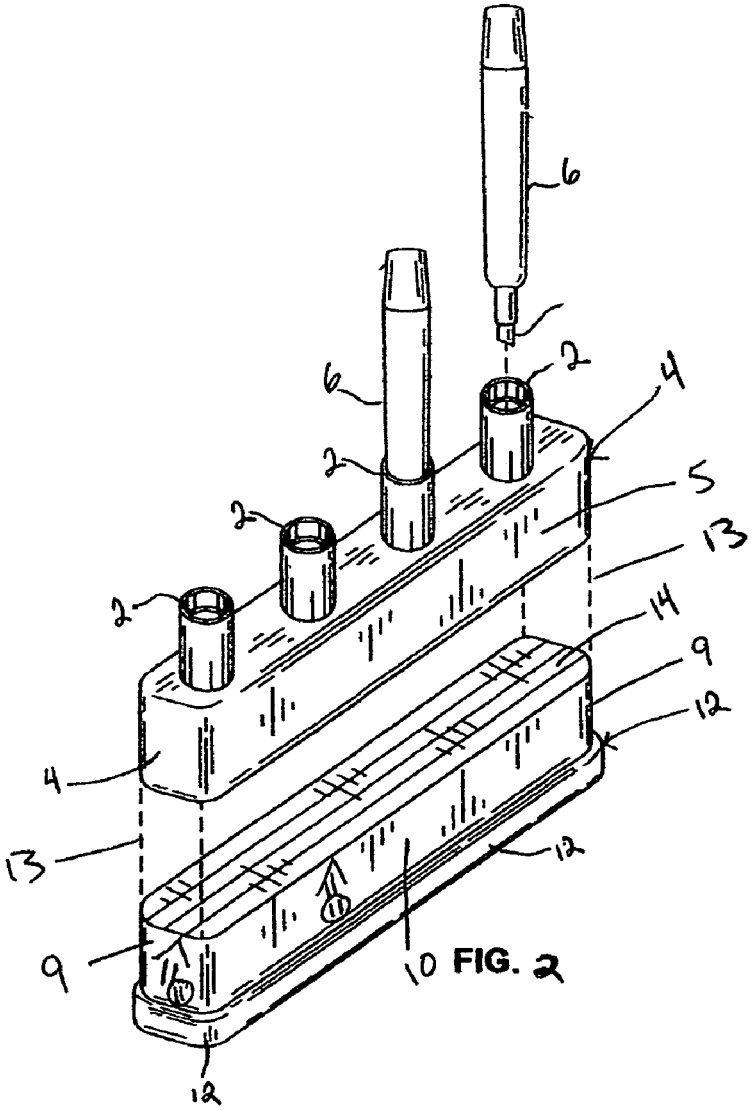
FIG. 2 is perspective view of the preferred embodiment of FIG. 1, showing the eraser assembly separated from the eraser housing of the common hand-gripable support element, thereby revealing the eraser surface that extends from the eraser grip, also showing a first marker having an exposed tip in a position ready for insertion into a marker tip receiving structure, and a second marker having an exposed tip fully received by a marker tip receiving structure.

Referring again to FIG. 1, to use the carrier of the invention, a user first disengages the cap of each marker to be inserted into the receiving structures 14 of the common hand-gripable support element 10. Ideally, each cap is then attached to the end of the marker opposite its tip. Next, the user inserts the tip of each marker into a corresponding marker tip receiving structure 14 of the common hand-gripable support element 10, as shown in FIG. 2.

With the eraser assembly 12 engaged within the common hand-gripable support element 10, the user can now easily select a marker for use as needed, without worrying about keeping track of the various caps. After use of a marker, the user reinserts the tip of the marker into any free marker tip receiving structure 14, as shown in FIG. 2. This serves to keep track of the marker, keep the marker readily available, and keep the tip of the marker protected from premature drying, without the need to find and replace the cap. Thus, a user can safely, effectively, and rapidly change among markers when making a multi-color presentation.

Further, in a preferred embodiment, when the user needs to erase some portion of the presentation, the user disengages the eraser assembly 12 from the eraser housing 11 of the common hand-gripable support element 10 with a simple pulling action, making the eraser accessible for use. The markers engaged with the common hand-gripable support element 10 remain engaged while the eraser is disengaged and in use.

Thus, the hand-gripable presentation marker carrier of the invention allows quick access to a plurality of different color markers, while in some embodiments, also allowing convenient access to an integrated eraser. The carrier is easy and comfortable to manipulate while a user is giving a presentation using a "dry erase" board and markers.

Other modifications and implementations will occur to those skilled in the art without departing from the spirit and the scope of the invention as claimed. Accordingly, the above description is not intended to limit the invention except as indicated in the following claims.

What is claimed is:

1. A hand-gripable dry erase marker carrier for simultaneously holding a plurality of dry erase markers and an eraser, the carrier comprising: a monolithically formed hand-gripable support element having an upper surface for receiving a plurality of marker-tip receiving structures, which project upward and perpendicular to said upper surface, said hand-gripable support element also including vertically extending side walls that project downward from side surfaces of said upper surface forming a cavity therein for receiving the eraser, said vertically extending side walls being formed from two short parallel side walls, which extend along an entire width of said hand-gripable support element and two long parallel side walls, which extend along an entire length of said hand-gripable support element, said eraser being formed from two short parallel side walls, two long parallel side walls, and includes a lip that projects outwardly from said walls for engagement with bottom surfaces of said vertically extending side walls thereby allowing the eraser to fit within said cavity, said plurality of marker-tip receiving structures are adapted for holding said plurality of dry erase markers simultaneously, each of said plurality of dry erase markers extend upward from said marker-tip receiving structures, respectively, said upper surface of said hand-gripable support element supporting each of said marker-tip receiving structures, wherein spacing between said marker-tip receiving structures being chosen to comfortably allow a typical-sized finger to pass between any pair of adjacent marker-tip receiving structures while said dry erase marker carrier is gripped by a user and wherein each marker-tip receiving structure serves as a cap to protect a tip of a dry erase marker from drying.

2. The carrier of claim 1, wherein an outer surface of said hand-gripable support element is the upper surface of the support element.

3. The carrier of claim 1, wherein the plurality of dry erase markers are held perpendicular with respect to said upper surface of said support element.

4. The carrier of claim 1, wherein the plurality of marker tip-receiving structures extend below said upper surface of said hand-gripable support element.

5. The carrier of claim 1, wherein each marker-tip receiving structure is shaped so as to grip a marker and hold it to the common hand-gripable support element regardless of the orientation of the common hand-gripable support element.

6. The carrier of claim 1, wherein the carrier further comprises: an eraser assembly cooperative with the eraser housing of the hand-gripable support element.

7. The carrier of claim 1, wherein an eraser housing includes said cavity into which an eraser assembly can be inserted, said cavity being formed below and directly opposite to said upper surface of said hand-gripable support element, which supports each of said marker-tip receiving structures.

* * * * *